US009938031B2

(12) United States Patent
Shurtleff et al.

(10) Patent No.: US 9,938,031 B2
(45) Date of Patent: Apr. 10, 2018

(54) METHOD OF PROCESSING A PLURALITY OF ARTICLES THROUGH A PROCESSING SECTION OF A PACKAGING MACHINE AND METHOD OF RECONFIGURING A PROCESSING SECTION OF A PACKAGING MACHINE

(71) Applicant: STANDARD KNAPP INC., Portland, CT (US)

(72) Inventors: David J. Shurtleff, Cromwell, CT (US); Patrick Lee Nelson, East Hampton, CT (US); David A. Kardok, Southington, CT (US)

(73) Assignee: STANDARD KNAPP INC., Portland, CT (US)

( * ) Notice: Subject to any disclaimer, the term of this patent is extended or adjusted under 35 U.S.C. 154(b) by 632 days.

(21) Appl. No.: 14/525,126

(22) Filed: Oct. 27, 2014

(65) Prior Publication Data

US 2016/0114927 A1 Apr. 28, 2016

(51) Int. Cl.

| | |
|---|---|
| ***B65B 11/00*** | (2006.01) |
| ***B65B 11/08*** | (2006.01) |
| ***B65B 21/24*** | (2006.01) |
| ***B65B 35/44*** | (2006.01) |
| ***B65B 35/40*** | (2006.01) |
| ***B65B 45/00*** | (2006.01) |
| ***B65B 49/14*** | (2006.01) |

(Continued)

(52) U.S. Cl.

CPC ..... *B65B 35/44* (2013.01); *B65B 35/405* (2013.01); *B65B 49/04* (2013.01); *B65B 49/10* (2013.01); *B65B 49/14* (2013.01)

(58) Field of Classification Search

CPC .. B65G 47/52; B31B 1/00; B31B 1/26; B65B 11/004; B65B 11/08; B65B 21/24; B65B 35/44; B65B 35/405; B65B 45/00; B65B 49/14

USPC ..... 198/418.7, 419.3; 493/423, 441; 53/448, 53/462, 543, 207, 209

See application file for complete search history.

(56) References Cited

U.S. PATENT DOCUMENTS 4,364,465 A 12/1982 Kraft et al.
4,460,349 A * 7/1984 Charron ..... B31B 1/00 493/131
4,638,729 A 1/1987 Woodworth et al.

(Continued)

FOREIGN PATENT DOCUMENTS

KR 20-0466816 Y1 5/2013

OTHER PUBLICATIONS

International Search Report and Written Opinion dated Jan. 11, 2016 in corresponding PCT Application No. PCT/US15/057331.

(Continued)

*Primary Examiner* — Andrew M Tecco
*Assistant Examiner* — Praachi M Pathak
(74) *Attorney, Agent, or Firm* — Cantor Colburn LLP

(57) ABSTRACT

A method of processing a plurality of articles through a processing section of a packaging machine includes guiding a plurality of articles supported on a support tray blank onto at least one additional conveyor extending about and riding on a conveyor, folding at least one of a leading edge flap and trailing edge flap of the support tray blank with at least one tray folding member provided on the at least one additional conveyor to form a portion of a support tray, and shifting the support tray along the conveyor.

21 Claims, 12 Drawing Sheets

(51) Int. Cl.
*B65B 49/04* (2006.01)
*B65B 49/10* (2006.01)

(56) References Cited

U.S. PATENT DOCUMENTS 4,642,967 A * 2/1987 Culpepper ..... B65B 5/026 198/419.1
4,736,569 A * 4/1988 Hudson ..... B65B 7/20 53/377.2
4,871,068 A * 10/1989 Dreyfus ..... B65D 5/2033 206/200
4,887,414 A * 12/1989 Arena ..... B65B 21/24 198/418.7
5,531,661 A * 7/1996 Moncrief ..... B65B 43/265 493/313
5,971,906 A * 10/1999 Tharpe, Jr. ..... B65D 71/0096 493/124
5,997,459 A * 12/1999 Kruger ..... B31F 1/08 493/161
7,470,226 B1 * 12/2008 Herrin ..... B65D 5/0045 493/125
7,503,157 B2 * 3/2009 Ford ..... B65B 5/068 53/233
8,448,777 B2 * 5/2013 Pazdernik ..... B65G 47/088 198/418.6
2014/0290178 A1 * 10/2014 Koster ..... B65B 11/004 53/397
2016/0114921 A1 * 4/2016 Shurtleff ..... B65B 43/10 53/564

OTHER PUBLICATIONS

International Search Report and Written Opinion dated Jan. 28, 2016 in related PCT Application No. PCT/US2015/057334.

* cited by examiner

METHOD OF PROCESSING A PLURALITY OF ARTICLES THROUGH A PROCESSING SECTION OF A PACKAGING MACHINE AND METHOD OF RECONFIGURING A PROCESSING SECTION OF A PACKAGING MACHINE

BACKGROUND OF THE INVENTION

Exemplary embodiments pertain to the art of packaging systems and, more particularly, to a process section of a packaging machine.

In-line continuous motion packaging machines are set up to process a particular package format. For example, a particular machine may be set up to process unsupported articles, articles supported on a pad, or articles supported on a tray. The machine may be adaptable for different package sizes, but typically not for different package types. More specifically, a packaging machine may include various changeover points that are adaptable for different package sizes. Different packaging sizes may accommodate different types, sizes, numbers and shapes of articles to be packaged in a particular packaging format.

Multi-format packaging machines are growing in popularity. A typical multi-format packaging machine will include a tray forming section. When in a tray package format, the tray forming section constructs a tray about a number of articles that may be subsequently wrapped with plastic. When in a pad package format or in an unsupported package format, the tray forming section is not needed. When not in use, the tray forming section may be lowered or removed from the packaging machine and replaced with a flight section. Lowering and/or removing the tray forming section is a labor intensive effort that requires many man hours and the use of material handling devices such as forklifts, jacks, and/or cranes, and the like. Further, once removed, there is a need to store the tray forming section which reduces available storage and work space about the machine.

BRIEF DESCRIPTION OF THE INVENTION

Disclosed is a method of processing a plurality of articles through a processing section of a packaging machine. The method includes guiding a plurality of articles supported on a support tray blank onto at least one additional conveyor extending about and riding on a conveyor, folding at least one of a leading edge flap and trailing edge flap of the support tray blank with at least one tray folding member provided on the at least one additional conveyor to form a portion of a support tray, and shifting the support tray along the conveyor.

Also disclosed is a method of reconfiguring a processing section of a packaging machine including shifting at least one additional conveyor between a first configuration in which the at least one additional conveyor extends about and rides on a conveyor and a second configuration in which the at least one additional conveyor is arranged laterally outwardly of the conveyor.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
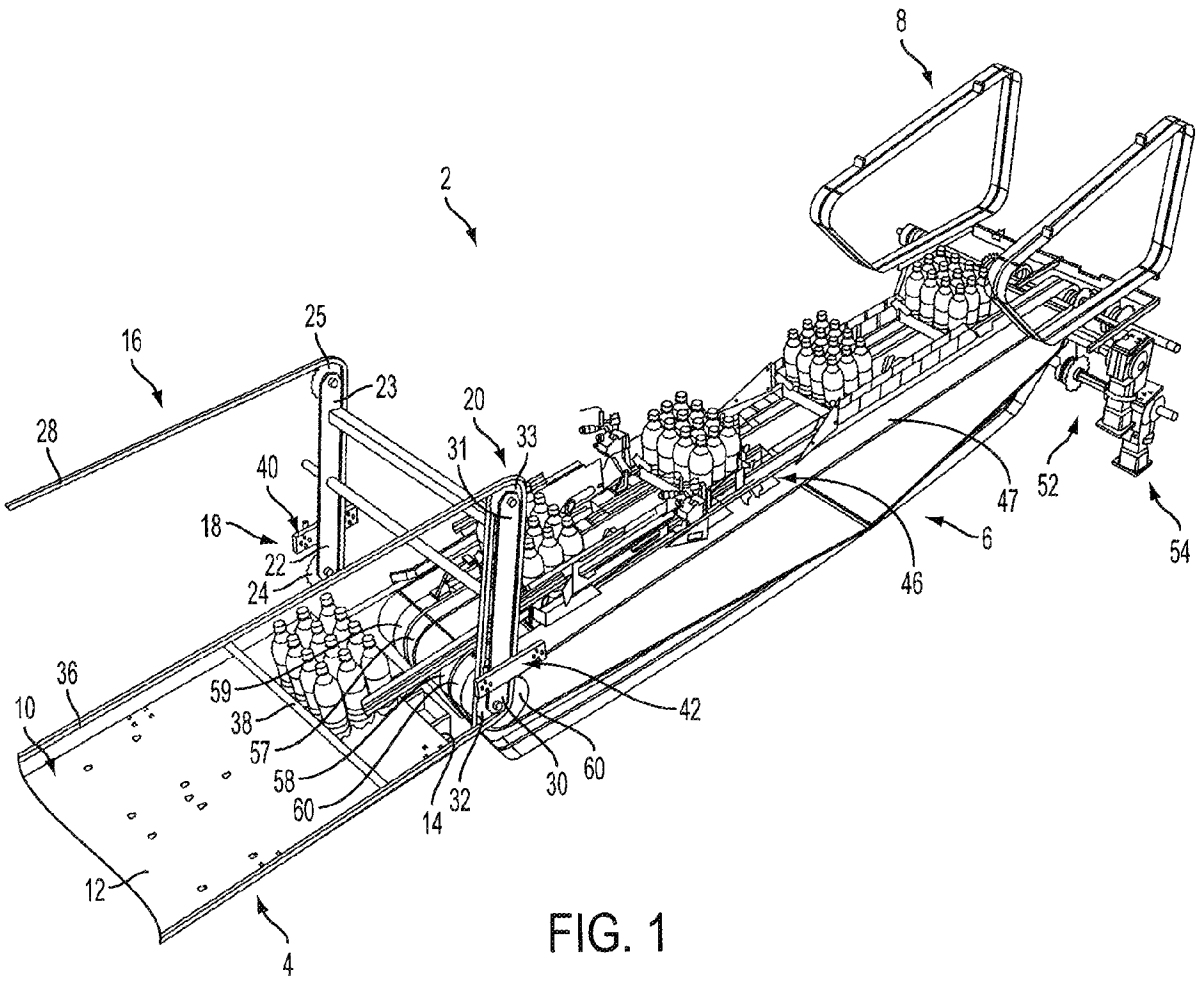
FIG. 1 depicts a partial perspective view of a processing section of a packaging machine in a tray supported article configuration, in accordance with an aspect of an exemplary embodiment.
Figure 2:
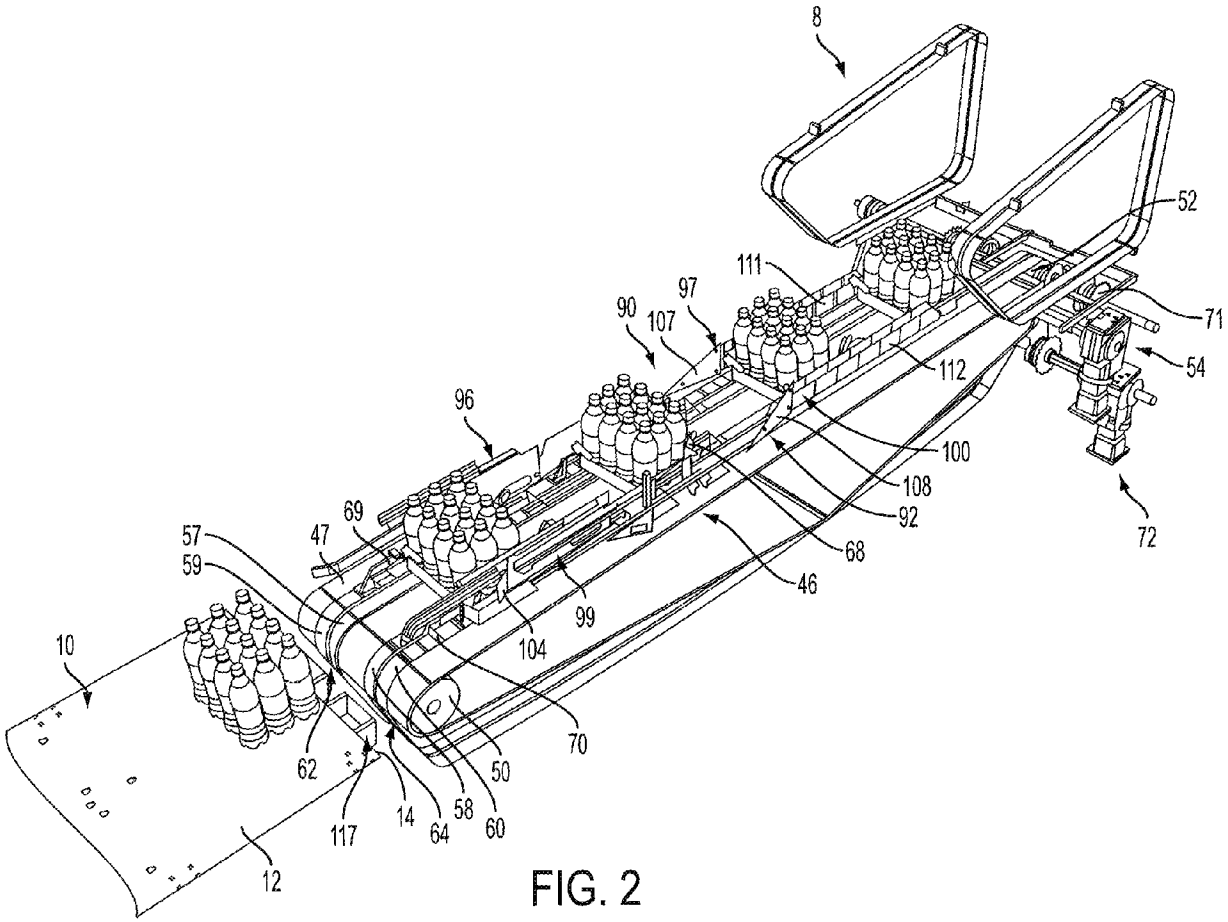
FIG. 2 depicts the processing section of FIG. 1 with a portion of a lead-in system removed.
Figure 3:
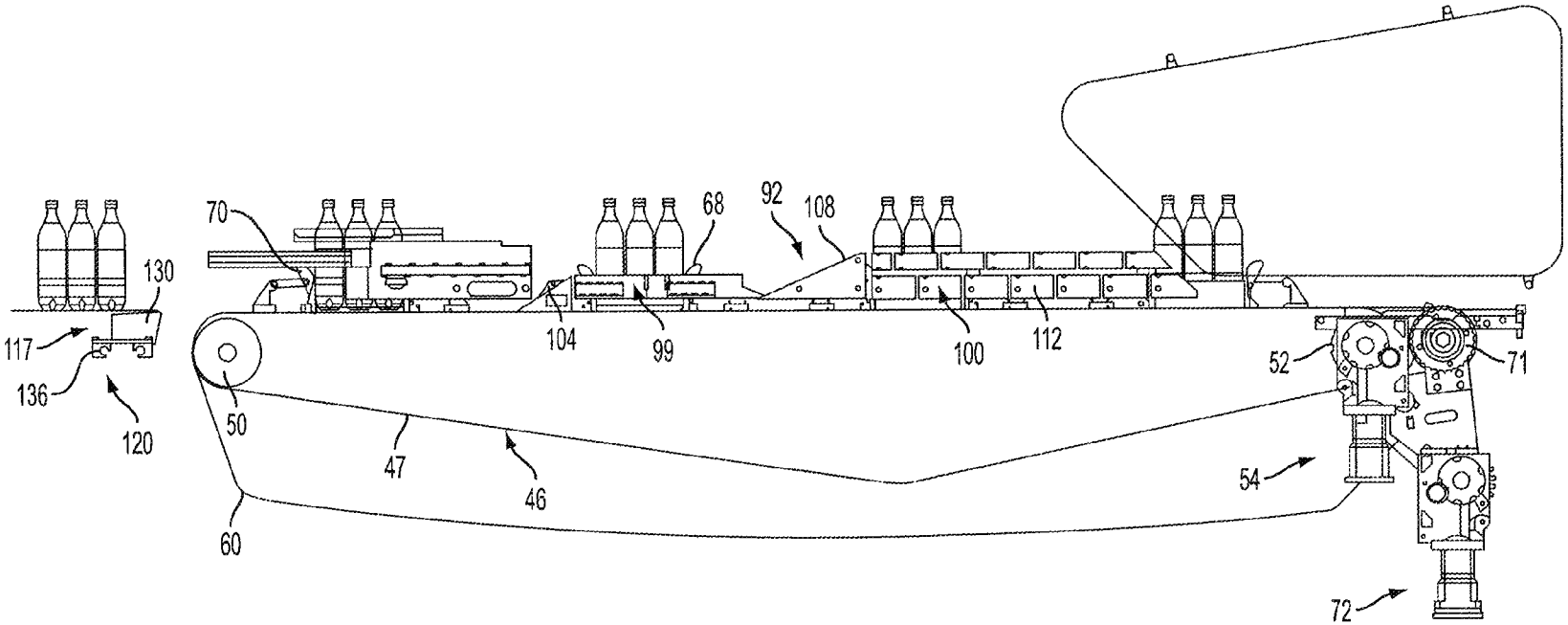
FIG. 3 depicts a side view of the processing section of FIG. 2.
Figure 4:
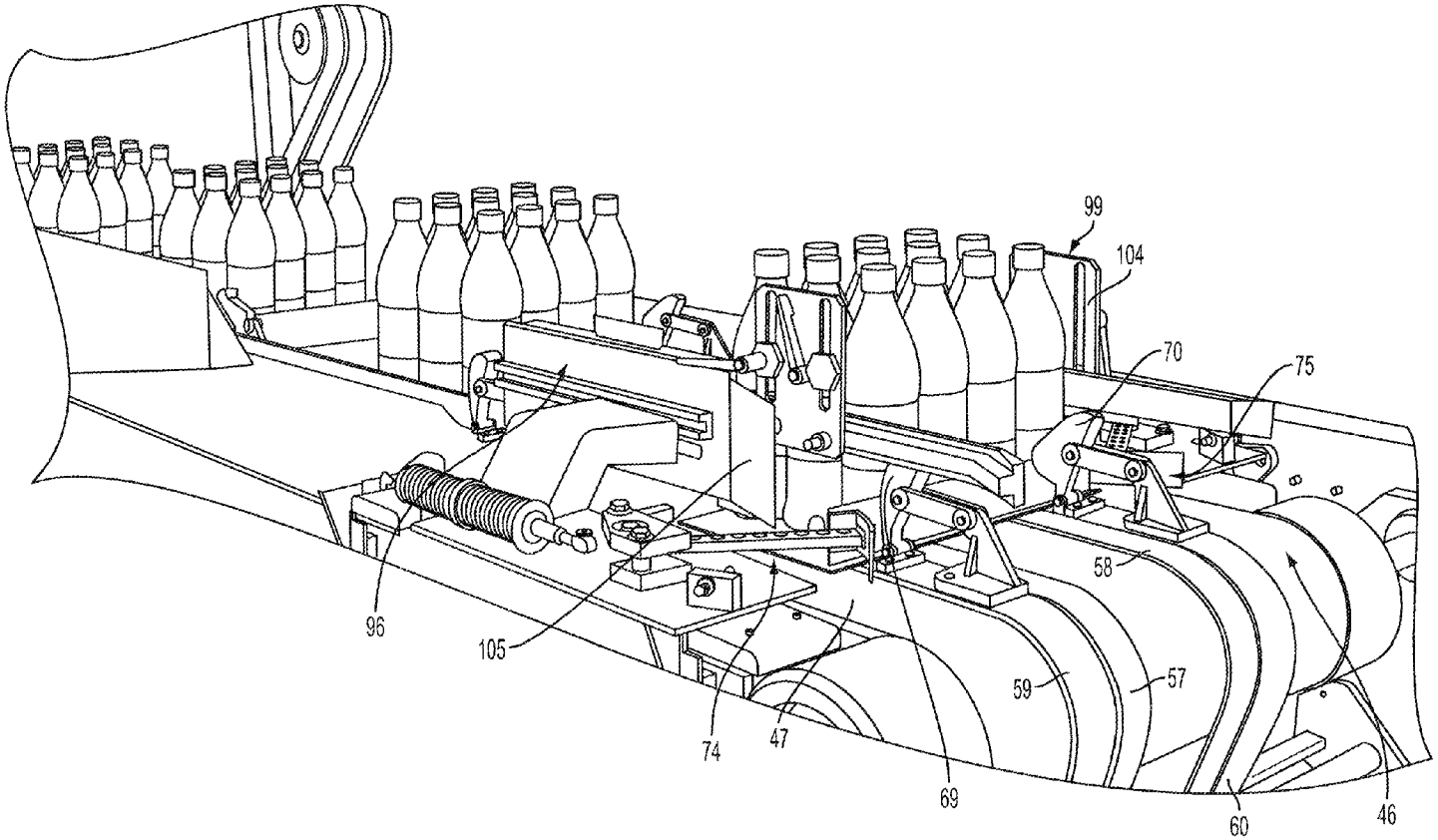
FIG. 4 depicts a partial perspective view of a trailing edge flap of a product support tray blank being acted upon by a first pair of tray folding members, in accordance with an aspect of an exemplary embodiment.
Figure 5:
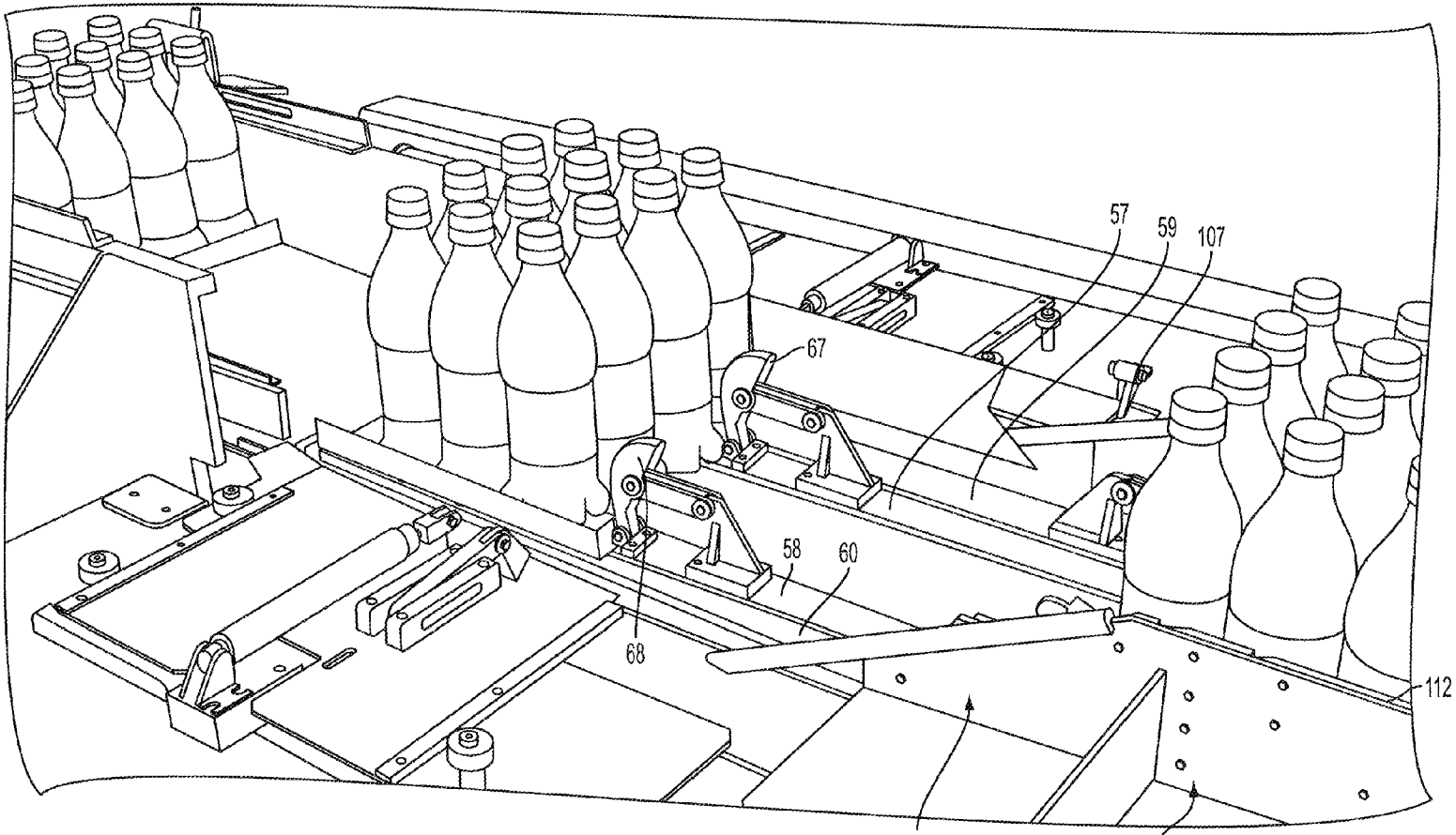
FIG. 5 depicts a partial perspective view of a leading edge flap of the product support tray blank being acted upon by a second pair of tray folding members, in accordance with an aspect of an exemplary embodiment.
Figure 6:
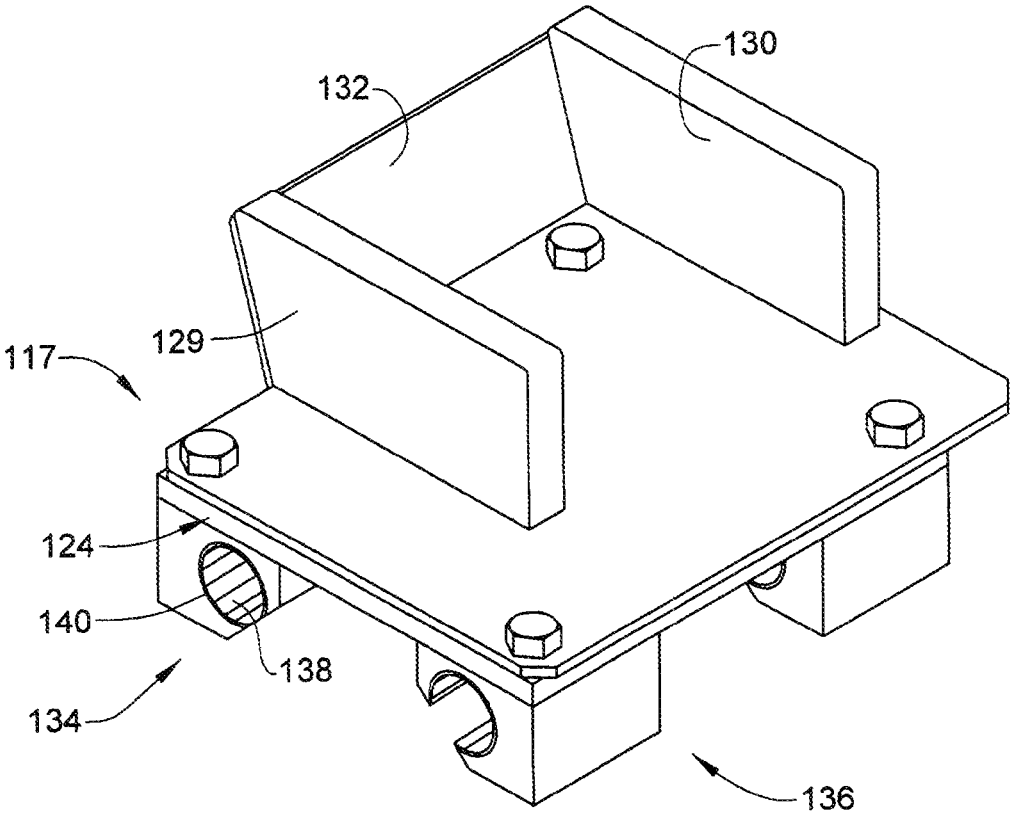
FIG. 6 depicts a perspective view of a transfer plate of the processing system of FIG. 1.

A processing section of a packaging machine is indicated generally at 2 in FIG. 1. Processing section 2 includes a lead-in system 4, a processing portion 6, and a lead-off system 8. Lead-off system 8 guides articles to a downstream process (not shown). Processing section 2 is mounted to a support frame (not shown). Lead-in system 4 includes a support member 10 having a substantially planar surface 12 and a downstream end 14. Lead-in system 4 also includes a product transport system 16 that guides products or articles to be packaged along support member 10 toward processing portion 6.

Product transport system 16 includes a first arm member 18 arranged on a first side of support member 10 and a second arm member 20 arranged on a second side of support member 10. First arm member 18 extends from a first end 22 to a second end 23. First end 22 includes a first pulley 24 and second end 23 includes a second pulley 25. First and second pulleys 24 and 25 may include a plurality of gear teeth (not separately labeled). First arm member 18 supports a first drive 28. Second arm member 20 extends from a first end 30 to a second end 31. First end 30 includes a first pulley 32 and second end 31 includes a second pulley 33. First and second pulleys 32 and 33 may include gear teeth (not separately labeled). Second arm member 20 supports a second drive 36. A bar 38 extends between first and second drives 28 and 36.

Bar 38 moves along support member 10 to motivate products toward processing portion 6. It should be understood that the first and second drives may take the form of belts, chains, and the like that may carry and/or motivate bar 38 along support member 10.

First arm member 18 is coupled to a first adjustment assembly 40 and second arm member 20 is coupled to a second adjustment assembly 42. First and second adjustment assemblies 40 and 42 allow first and second arm members 18 and 20 to pivot about corresponding ones of first ends 22, 30. In this manner, bar 38 may be phased forward and/or rearward. For example, when in a tray processing configuration, as shown in FIGS. 1-4, first and second arm members 18 and 20 may be phased forward.

Figure 7:
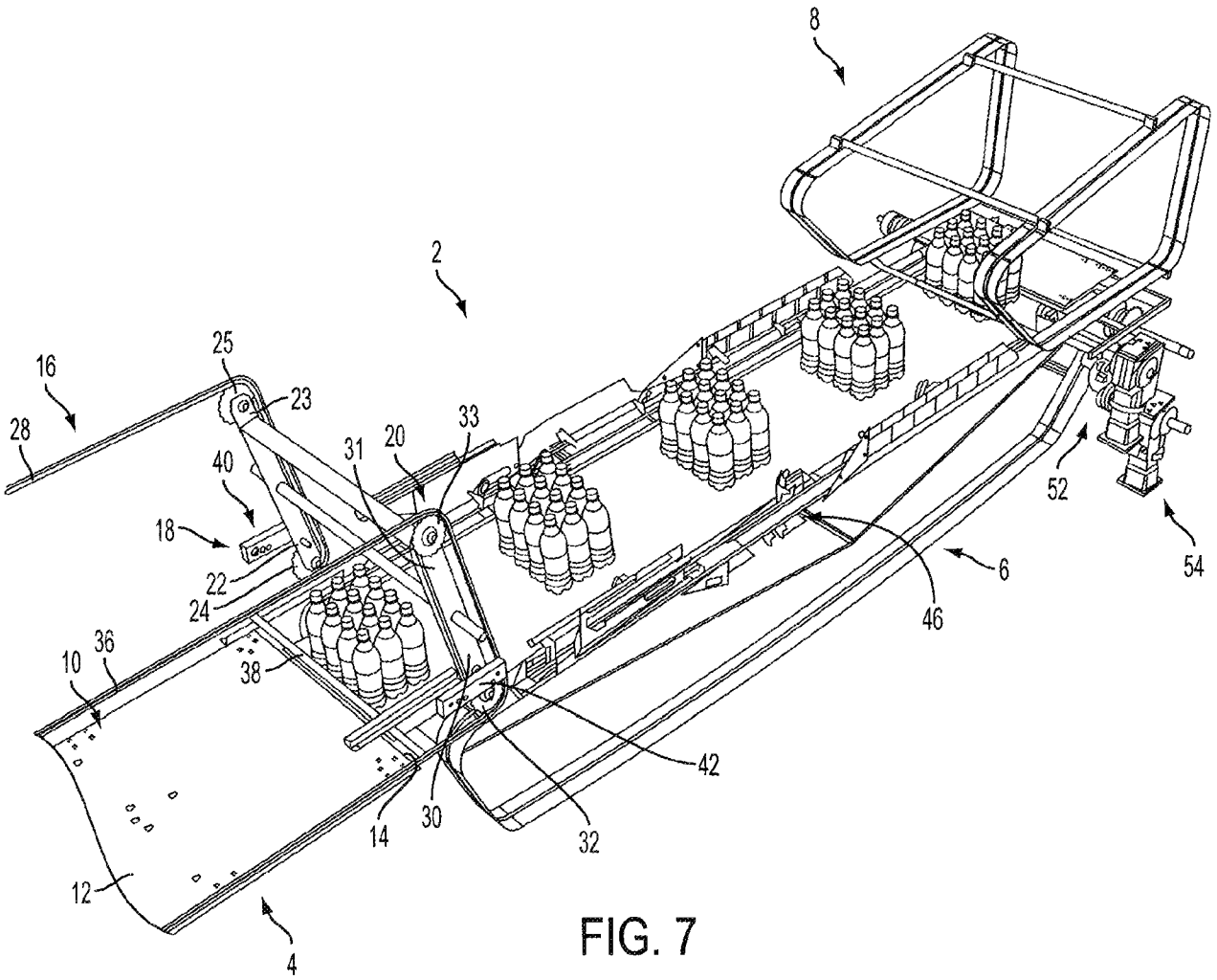
FIG. 7 depicts a partial perspective view of the processing section of FIG. 1 in an unsupported article configuration, in accordance with another aspect of an exemplary embodiment.
Figure 11:
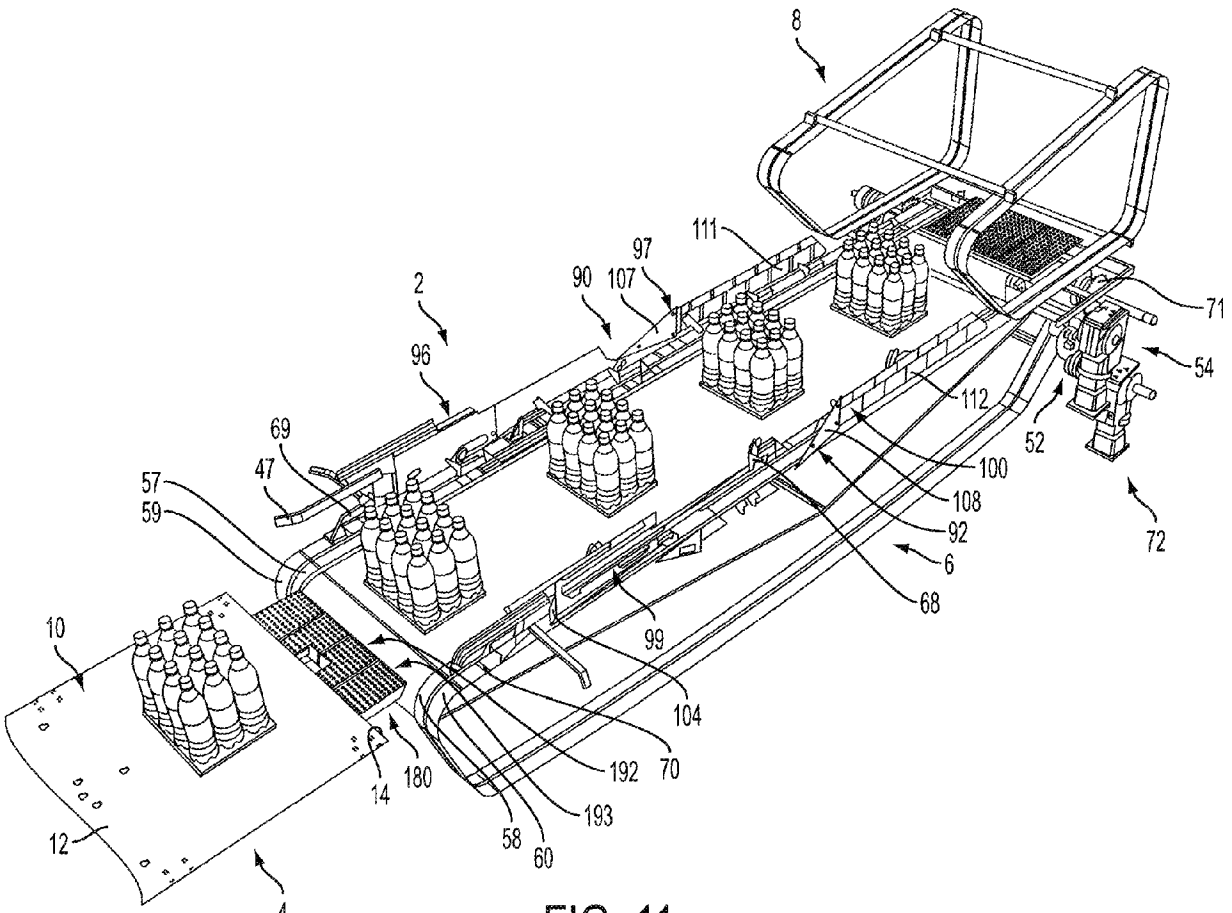
FIG. 11 depicts a partial perspective view of the processing section of FIG. 1 in a pad supported article configuration with the portion of the lead-in system removed, in accordance with another aspect of an exemplary embodiment.

In an unsupported article processing configuration, such as shown in FIG. 7, first and second arm members 18 and 20 may be phased rearward. Phasing arm members 18 and 20 rearward shifts a position of pulleys 24 and 32 and first and second drives 28 and 36 toward processing section 6. Phasing arm members 18 and 20 rearward to shift bar 38 forward provides additional motivational support or increases a contact time between bar 38 and the unsupported articles to maintain a desired spacing between the articles and facilitate a tightly packed package. First and second arm members 18 and 20 may also be arranged in the second position when processing section 2 is in a pad supported article processing configuration, such as shown in FIG. 11.

As shown in FIGS. 2-5, processing portion 6 includes a conveyor 46 having an outer surface 47. The term "conveyor", as used in accordance with the exemplary embodiments, should be understood to include belts, chains, or other systems continuous or otherwise that transport an article from one position to another. Conveyor 46 is supported by a first roller member 50 and a second roller member 52. Second roller member 52 is operably connected to a first drive member 54. Processing portion 6 also includes a first additional conveyor 57, a second additional conveyor 58, a third additional conveyor 59 and a fourth additional conveyor 60. At this point, while shown with four additional conveyors, it should be understood that processing section 6 may include only a single additional conveyor.

As will be detailed more fully below, additional conveyors 57-60 selectively extend about and ride on outer surface 47 of conveyor 46. More specifically, in the tray processing configuration first and third additional conveyors 57 and 59 define a first pair of additional conveyors 62 arranged on a first lateral side (not separately labeled) of conveyor 46, and second and fourth additional conveyors 58 and 60 define a second pair of additional conveyors 64 arranged on a second, opposing lateral side (not separately labeled) of conveyor 46. When in the unsupported or pad supported processing configuration, first and second pairs of additional conveyors 62 and 64 are shifted laterally outwardly of conveyor 46.

First additional conveyor 57 includes a first plurality of tray folding members 67 and second additional conveyor 59 includes a second plurality of tray folding members 68. Tray folding members 67 and 68 are arranged in aligned pairs that move along conveyor 46. Tray folding members 67 and 68 are pivotable and operated to fold a leading edge flap (not separately labeled) of a support tray blank (also not separately labeled) upward. More specifically, as articles supported on the tray blank are transferred to processing system 6 from lead-in system 4, tray folding members 67 and 68 interact with and fold the leading edge flap upward. It should also be understood that the additional conveyor could include other structure or could be devoid of any additional structure.

Third additional conveyor 59 includes a third plurality of tray folding members 69 and fourth additional conveyor 60 includes a fourth plurality of tray folding members 70. Tray folding members 69 and 70 are arranged in aligned pairs that move along conveyor 46. Tray folding members 69 and 70 are pivotable and operated to fold a trailing edge flap (not separately labeled) of the support tray blank upward. More specifically, as articles supported on the tray blank are transferred from lead-in system 4 to processing system 6, tray folding members 69 and 70 interact with and fold the trailing edge flap upward. Tray folding members 69 and 70 also assist in providing a motivational force to move the articles supported on the support tray blank onto conveyor 46.

Each of additional conveyors 57-60 are connected to a corresponding geared pulley such as shown at 71. Geared pulleys 71 are driven by a second drive member 72. Geared pulleys 71 interact with gear teeth (not separately labeled) provided on an underside (also not separately labeled) of each additional conveyor 57-60. In this manner, additional conveyors 57-60 maintain a desired relative alignment but also a desired timing relative to conveyor 46. In accordance with an aspect of an exemplary embodiment, first drive member 52 drives conveyor 46 at a first speed and second drive member 72 drives additional conveyors at a second speed. In accordance with another aspect of the exemplary embodiment, the first speed is distinct from the second speed. In accordance with another aspect of the exemplary embodiment, the first speed is less than the second speed.

Processing portion 6 also includes a first selectively deployable folding element 74 and a second selectively deployable folding element 75. First and second selectively deployable folding elements 74 and 75 are pivoted to fold corresponding first and second flap portions (not separately labeled) of the trailing edge flap of the support tray blank toward the leading edge flap. Processing portion 6 may also include a first selectively deployable compression assembly 90 and a second selectively deployable compression assembly 92. First and second selectively deployable compression assemblies 90 and 92 are arranged on lateral sides of conveyor 46 and, as will be detailed more fully below, operated to interact with the support tray blank to form a support tray (not separately labeled). First selectively deployable compression assembly 90 includes a first portion 96 and a second portion 97. Second portion 97 is arranged downstream of first portion 96. Similarly, second selectively deployable compression assembly 92 includes a first portion 99 and a second portion 100. Second portion 100 is arranged downstream of first portion 99.

First portion 96 of first selectively deployable compression assembly 90 includes a first angled lead-in section 104. Similarly, first portion 99 of second selectively deployable compression assembly 92 includes a first angled lead-in section 105. First angled lead-in sections 104 and 105 operate to fold corresponding first and second flap portions (not separately labeled) of the leading edge flap of the support tray blank toward the trailing edge flap. Second portion 97 of first selectively deployable compression assembly 90 includes a second angled lead-in section 107 and second portion 100 of second selectively deployable compression assembly 92 includes a second angled lead-in section 108. Second angled lead-in sections 107 and 108 operate to fold opposing side portions (not separately labeled) of the support tray blank toward one another and onto the first and second flap portions of corresponding ones of the leading edge flap and the trailing edge flap to establish a support tray form (also not separately labeled).

At this point, the support tray form is passed through a first plurality of compression members 111 provided on second portion 97 of first selectively deployable compression assembly 90, and a second plurality of compression members 112 is provided on second portion 100 of second selectively deployable compression assembly 92. Compression members 111 and 112 are positioned to urge the opposing side portions of the support tray blank onto the first and second flap portions of corresponding ones of the leading edge flap and the trailing edge flap to initiate a bonding process that forms the support tray. First and second selectively deployable compression assemblies 90 and 92 may be positioned relative to one another to accommodate a wide range of tray sizes. Further, additional compression members (not shown) may be arranged downstream of first and second selectively deployable compression assemblies 90 and 92 if a longer bonding time is desired.

Processing section 2 may also include a transfer plate 117 that bridges a gap (not separately labeled) between lead-in system 4 and processing portion 6. Transfer plate 117 is slidingly supported on one or more mounting rails 120 that extend substantially perpendicularly to a direction of movement of conveyor 46. It should be understood that additional transfer plates (not separately labeled) may also exist between processing section 6 and lead-off system 8. The additional transfer plates may be dropped into place across a gap (also not separately labeled) between processing section 6 and lead-off section 8 or slide into place on mounting rails (not shown). It should also be understood that the particular shape and arrangement of the mounting rails may vary. Mounting rails 120 allow for a rapid reconfiguration of processing section 2 between tray supported article processing, unsupported article processing, and pad supported article processing. In the tray processing configuration, transfer plate 117 includes a body 124 including a first tray slide 129 and a second tray slide 130. First and second tray slides 129 and 130 facilitate a transfer from lead-in system 4 and processing portion 6. Body 124 also supports first and second pairs of mounting elements 134 and 136. Each mounting element 134 and 136 includes a hook section 138 that may include a plurality of grooves 140. Grooves 140 reduce contact area between pairs of mounting elements 134 and 136 and mounting rails 120 to ease installation and removal of transfer plate 117. Of course, it should be understood that the number and form of the mounting elements may vary.

Figure 8:
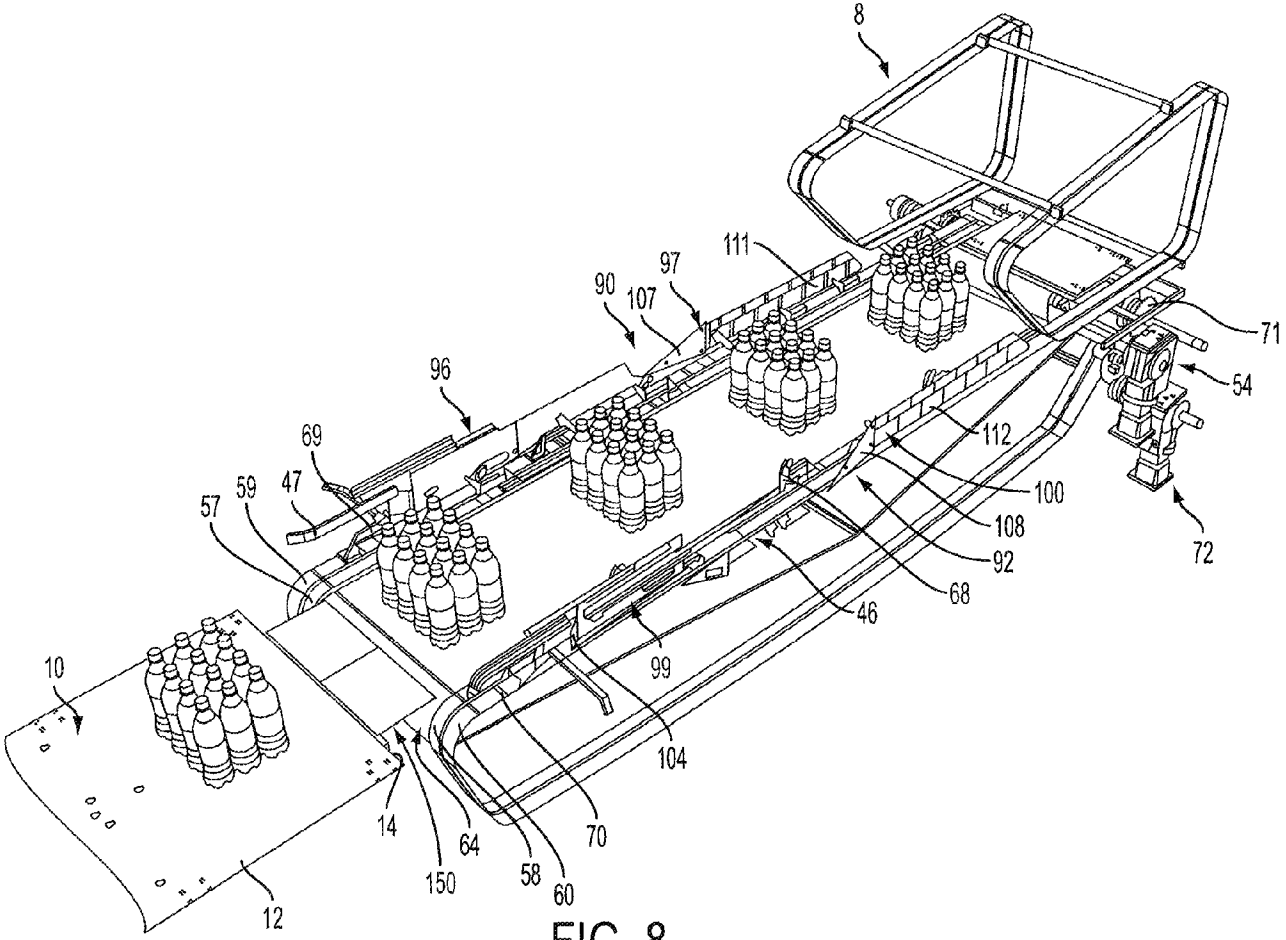
FIG. 8 depicts the processing section of FIG. 7 with the portion of the lead-in system removed.
Figure 9:
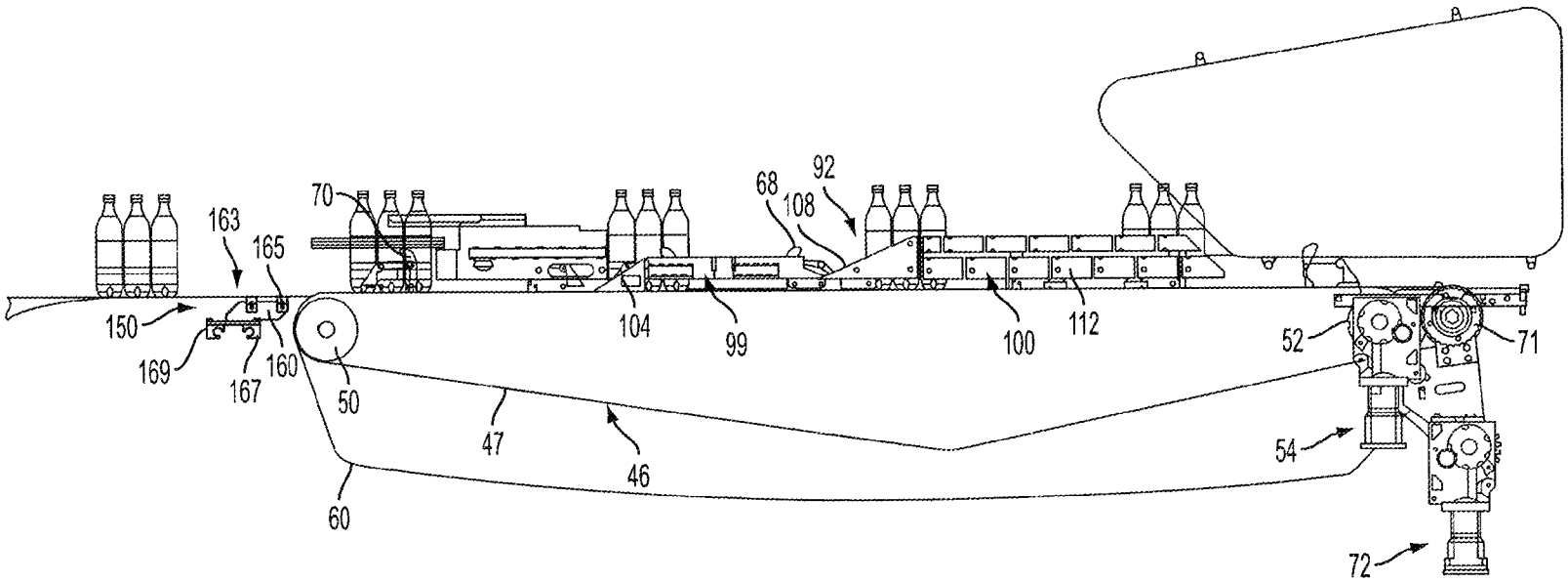
FIG. 9 depicts a side view of the processing section of FIG. 8.

As noted above, processing section 2 is readily reconfigurable between the tray supported article processing configuration (FIGS. 1-3), the unsupported article processing configuration (FIGS. 7-9) and the pad supported article processing configuration (FIG. 11). Reconfiguration may take thirty minutes or less and require little if any support equipment. For example, when reconfiguring from the tray supported article processing configuration to the unsupported article processing configuration, additional conveyors 57-60 are moved laterally outwardly of conveyor 46. Geared pulley(s) 72 are shiftable along an axel (not separately labeled) and first pair of additional conveyors 62 may be shifted to a first lateral side of conveyor 46 and second pair of additional conveyors 64 may be shifted to a second, opposing lateral side of conveyor 46, as shown in FIGS. 7 and 8.

Figure 10:
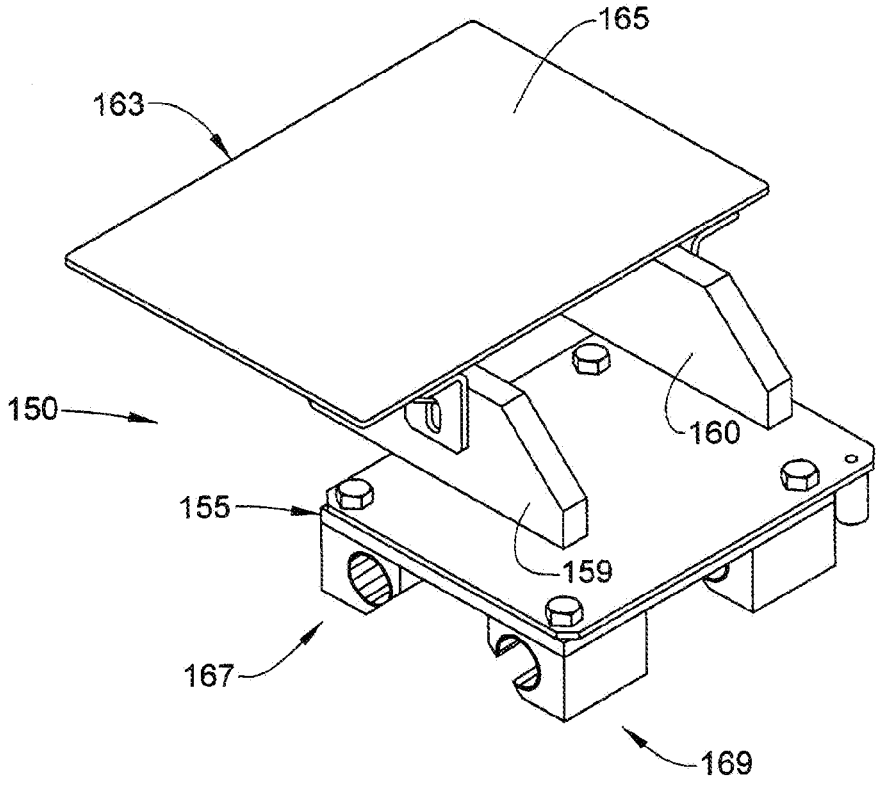
FIG. 10 depicts a perspective view of a transfer plate of the processing system of FIG. 7.

In addition to the outward shifting of additional conveyors 57-60, first compression assembly 90 is shifted to the first lateral side of conveyor 46 and second compression assembly 92 is shifted to the second lateral side of conveyor 46. In this manner, an unobstructed process flow path is established between lead-in system 4 and lead-off system 8. In addition, transfer plate 117 is replaced by a transfer plate 150 that is configured to lead unsupported articles from lead-in system 4 onto conveyor 46, as shown in FIG. 10. Transfer plate 150 is slidingly supported on mounting rails 120. It should be understood that additional transfer plates (not separately labeled) may also exist between processing section 6 and lead-off system 8. The additional transfer plates may be dropped into place across a gap (also not separately labeled) between processing section 6 and lead-off section 8 or slide into place on mounting rails (not shown). Transfer plate 150 includes a body 155 that supports first and second mounting rail elements 159 and 160 that support a plate 163. Plate 163 includes a substantially planar surface 165. Transfer plate 150 also includes first and second pairs of mounting elements 167 and 169 that are similar to mounting elements 134 and 136. Of course, it should be understood that the number and form of the mounting elements may vary.

Figure 12:
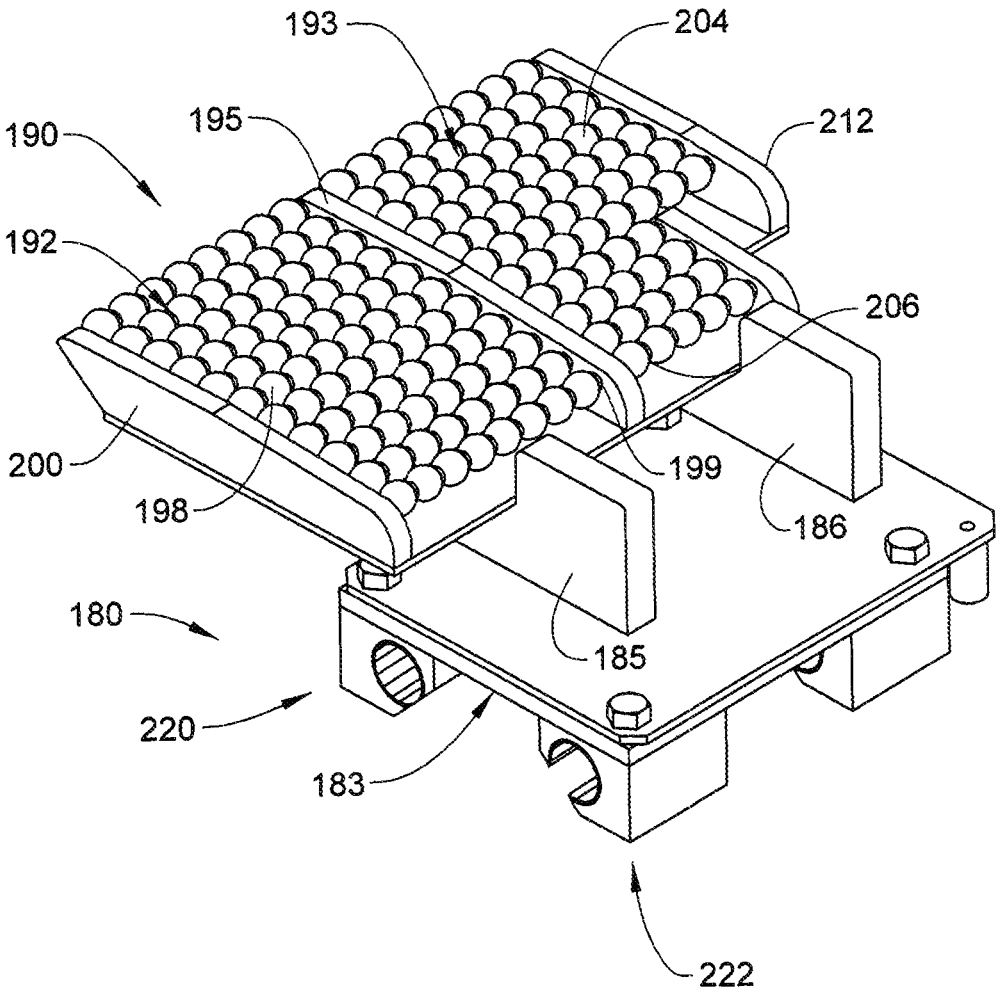
FIG. 12 depicts a perspective view of a transfer plate of the processing system of FIG. 11.

When reconfiguring from the unsupported article processing configuration (FIGS. 7-9) to the pad supported article processing configuration (FIG. 11), transfer plate 150 is readily replaced with a transfer plate 180 as shown in FIG. 12. Transfer plate 180 is slidingly supported on mounting rails 120. It should be understood that additional transfer plates (not separately labeled) may also exist between processing section 6 and lead-off system 8. The additional transfer plates may be dropped into place across a gap (also not separately labeled) between processing section 6 and lead-off section 8 or slide into place on mounting rails (not shown). Transfer plate 180 includes a body 183 that supports first and second mounting rail elements 185 and 186. Mounting rail elements 185 and 186 support a roller assembly 190. Roller assembly 190 includes a first roller section 192 and a second roller section 193 separated by a dividing wall 195. A plurality of rollers 198 are supported upon an axel 199 between an outer wall 200 and dividing wall 195 in first roller section 192. Similarly, a second plurality of rollers 204 is supported on axels 206 that extend between a second outer wall 212 and dividing wall 195 in second roller section 193. Roller assembly 190 facilitates the transfer of pad supported articles from lead-in system 4 onto conveyor 46. At this point it should be understood that processing section 6 may be reconfigured from tray supported article processing configuration and pad supported processing configuration. Transfer plate 180 also includes first and second pairs of mounting elements 167 and 169 that are similar to mounting elements 220 and 222. Of course, it should be understood that the number and form of the mounting elements may vary.

At this point it should be understood that the exemplary embodiments provide a readily reconfigurable processing section for a packaging machine. More specifically, the processing section may be reconfigured, in thirty minutes or less between a tray supported article processing configuration, an unsupported article processing configuration and/or a pad supported article processing configuration. Moreover, reconfiguration may be done by one or more people without the need for support equipment such as cranes, jacks, forklifts, and the like.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method of processing a plurality of articles through a processing section of a packaging machine, the method comprising:

guiding a plurality of articles supported on a support tray blank onto at least one additional conveyor extending about and riding on a conveyor;

folding at least one of a leading edge flap and trailing edge flap of the support tray blank with at least one tray folding member provided on the at least one additional conveyor to form a portion of a support tray; and shifting the support tray blank along the conveyor.

2. The method of claim 1, further comprising: folding another of the leading edge flap and the trailing edge flap with another tray folding member provided on another additional conveyor arranged alongside the at least one additional conveyor.

3. The method of claim 1, wherein shifting the support tray along the conveyor includes moving the support tray toward a compression assembly.

4. The method of claim 3, further comprising: guiding the support tray blank through a first portion of an angled lead-in section of the compression assembly to fold first and second side flap portions of the leading edge flap.

5. The method of claim 4, further comprising: folding first and second side flap portions of the trailing edge flap with selectively deployable folding elements.

6. The method of claim 5, further comprising: guiding the support tray blank through another portion of the angled lead-in section to fold opposing side portions of the support tray blank onto the first and second flap portions of corresponding ones of the leading edge flap and the trailing edge flap.

7. The method of claim 6, further comprising: passing the support tray blank through a portion of the compression assembly to join the first and second opposing side portions to the first and second flap portions of the corresponding ones of the leading edge flap and the trailing edge flap.

8. The method of claim 1, wherein guiding the plurality of articles supported on a support tray blank onto the at least one additional conveyor includes motivating the plurality of articles from a support member onto the at least one additional conveyor with a bar movingly supported between a first arm member and a second arm member.

9. The method of claim 8, further comprising: passing the plurality of articles along at least one tray slide provided on a transfer plate mounted between the support member and the at least one additional conveyor.

10. The method of claim 9, further comprising: shifting the at least one additional conveyor laterally outwardly of the conveyor to reconfigure the processing section from a tray supported processing configuration to one of an unsupported article processing configuration and a pad supported article processing configuration.

11. The method of claim 10, further comprising: shifting a compression assembly laterally outwardly of the conveyor to reconfigure the processing section from the tray supported processing configuration to the one of the unsupported article processing configuration and the pad supported article processing configuration.

12. The method of claim 10, further comprising: pivoting the first and second arm members to shift a position of the bar relative to the a downstream end of the support member in the one of the unsupported article processing configuration and a pad supported article processing configuration.

13. The method of claim 10, further comprising: replacing the transfer plate having the at least one tray slide with a transfer plate including a substantially planar surface to establish the unsupported article processing configuration.

14. The method of claim 10, further comprising: replacing the transfer plate having the at least one tray slide with a transfer plate including a plurality of rollers to establish the pad supported article processing configuration.

15. The method of claim 1, further comprising: reconfiguring the processing section from a tray supported article processing configuration in which the at least one additional conveyor extends about and moves with the conveyor to one of an unsupported article processing configuration and a pad supported article processing configuration in which the at least one additional conveyor is positioned laterally outwardly of the conveyor in thirty minutes or less.

16. The method of claim 1, further comprising: driving the conveyor with a first drive member at a first speed and the at least one additional conveyor with a second drive member that is distinct from the first drive member at a second speed that is distinct from the first speed.

17. The method of claim 16, wherein driving the conveyor at the first speed includes driving the conveyor at a speed that is less than the second speed.

18. The method of claim 1, wherein guiding the plurality of articles supported on a support tray blank onto the at least one additional conveyor extending about and riding on a conveyor includes guiding the plurality of articles onto a first pair of additional conveyors including a first plurality of tray folding members and a second pair of additional conveyors including a second plurality of tray folding members.

19. The method of claim 18, wherein folding the at least one of the leading edge flap and the trailing edge flap with the at least one tray folding member includes folding the leading edge flap with two of the first pluralities of tray folding members.

20. The method of claim 19, wherein folding the at least one of the leading edge flap and the trailing edge flap with the at least one tray folding member includes folding the trailing edge flap with two of the second pluralities of tray folding members.

21. The method of claim 20, further comprising: motivating the plurality of articles supported on the support tray blank onto the first and second pairs of additional conveyors with the two of the second pluralities of tray folding members.

* * * * *